US005346193A

United States Patent [19]

Kitagawa

[11] Patent Number: 5,346,193

[45] Date of Patent: Sep. 13, 1994

[54] APPARATUS FOR SUCKING BY NEGATIVE PRESSURE

[75] Inventor: Shinsuke Kitagawa, Fuchu, Japan

[73] Assignee: Kitagawa Kogyo Co., Ltd., Hiroshima, Japan

[21] Appl. No.: 949,033

[22] Filed: Sep. 22, 1992

[30] Foreign Application Priority Data

Oct. 8, 1991 [JP] Japan ..... 3-090616[U]
Oct. 8, 1991 [JP] Japan ..... 3-090617[U]

[51] Int. Cl.[5] ..... B25B 11/00
[52] U.S. Cl. ..... 269/21; 269/74
[58] Field of Search ..... 269/21, 266, 20, 297–301, 269/74, 58; 294/641; 279/3; 51/235

[56] References Cited

U.S. PATENT DOCUMENTS 4,088,312 5/1978 Frosch et al. ..... 269/21
4,491,306 1/1985 Eickhorst ..... 269/21
4,527,783 7/1985 Collora et al. ..... 269/21
4,530,635 7/1985 Engelbrecht et al. ..... 269/21
4,656,791 4/1987 Herrington et al. ..... 269/21

*Primary Examiner*—Robert C. Watson

[57] ABSTRACT

An apparatus for securing an article in a fixed position using a plurality of holders is provided. Each of the holders includes a hollow piston that is slidably mounted in the holder and is movable to ascended and descended positions. Each holder includes a suction cup at one end and an opening at the other end. A vacuum at the suction cups in sealing engagement with the article permits the holder to maintain the article in a fixed position. The piston of each holder that is not required to secure the article may be moved to the descended position. The piston may then be clamped in the descended position by engaging a hook mounted on the holder to a pin mounted on the piston.

6 Claims, 6 Drawing Sheets

APPARATUS FOR SUCKING BY NEGATIVE PRESSURE

BACKGROUND OF THE INVENTION

This invention relates to an apparatus for sucking an article like a workpiece to be cut by a woodworking machine by negative pressure.

The workpiece which is to be cut by a woodworking machine is held by an apparatus for sucking by negative pressure as shown in FIGS. 1–2 in general.

In FIGS. 1–2, the apparatus has a plane shaped table 1 the inside of which is provided with a negative pressure recess 2. This recess 2 is connected with a tube 3 which is attached to one side wall 1A of the table 1. A pointed end of the tube 3 is connected with a vacuum pump (not shown) or a blower (not shown) which sucks the air in the recess 2.

The top wall 1B of the table 1 is provided with a big opening 4 and this opening 4 is covered with a plate 5 which is mounted on the top wall 1B. The plate 5 is provided with a opening 6 which is connected with the opening 4 of the top wall 1B.

According to the above construction, a workpiece 7 is mounted on the top surface of the plate 5 in such a condition that the workpiece 7 covers the opening 6 of the plate, then the vacuum pump or the blower is operated, so that the air in the recess 2 is drawn. As a result, one part of the workpiece 7, which part is facing the opening 6 is sucked below and the workpiece 7 is held on the plate 5.

It is possible to adhere a seal member on the plate 5 in order to increase the airtightness and the coefficient of friction between the plate 5 and the workpiece 7.

However, there are many sizes and shapes of workpieces 7, so that it is necessary to provide many kinds of plates 5 corresponding to many kinds of workpieces 7. As a result, much money and much time are necessary to manufacture many plates 5, and wide space is necessary to keep the plates 5.

Moreover, it is difficult to manufacture many kinds of workpieces 7. Furthermore, the shapes of the plates 5 are changed while the long preservation, so that the quality of the plate 5 becomes worse.

If the workpiece 7 is changed, it is necessary to change the old plate 5 into new plate 5 corresponding to the new workpiece 7.

In case of using a seal member on the plate 5, it is necessary to maintain the seal member, and the measure of the workpiece varies according to the thickness of the seal member.

SUMMARY OF THE INVENTION

The object of this invention is to provide an apparatus for sucking an article by negative pressure which can overcome the above and the other problems encountered in the prior art apparatus, which can hold a workpiece without using the plate, and which can achieve the elevation of the productivity, the fall of manufacturing costs and the elevation of the quality of the products.

An apparatus according to this invention for sucking an article on a table the inside of which is provided with a negative pressure recess by negative pressure, comprising; plural openings each of which is made in the top wall of the table and is connected with the recess; plural blind caps each of which detachably fitted into the openings; plural sucking pads each of which is detachably fitted into the opening and is provided with a sucking passage extended to the top surface of the pad.

Another apparatus according to this invention for sucking an article on a table the inside of which is provided with a negative pressure recess by negative pressure, comprising; plural openings each of which is made in the top wall of the table and is connected with the recess; valves each of which is fitted in the opening and is provided with a valve body forced up by an elastic member to obstruct the ventilation of the air in the valve body's free condition and descended to permit the ventilation of the air; plural sucking pads each of which is detachably fitted on the valve to descend the valve body and is provided with a sucking passage extended to the top surface of the pad.

The other apparatus according to this invention for sucking an article on a table the inside of which is provided with a negative pressure recess by negative pressure, characterized in that the upper part of the table is provided with plural sucking mechanisms each of which comprising; a vertically movable piston forced up by an elastic member, the top of which piston is provided with a sucking pad and the inside of which is provided with a air passage from the top to the bottom; a hook device clamping the piston in its descending position and releasing the clamped piston with the descent of the piston; an intercepting device intercepting the air passage in the piston in its descending position from the negative pressure recess.

According to this invention, an articles such as a workpiece is certainly held on the sucking pad without using a plate which was shown in the prior art apparatus.

DETAILED DESCRIPTION OF THE INVENTION

Each of the embodiments of this invention relates to the construction around the upper part of the table in the prior art apparatus, and the construction of the negative pressure recess formed in the table and the same of the vacuum pump or the blower which draws the air in the recess of each embodiment of this invention are the same as those of the prior art apparatus. Under these circumstances, the explanation of the negative pressure recess and the vacuum pump or the blower is omitted.

Figure 3:
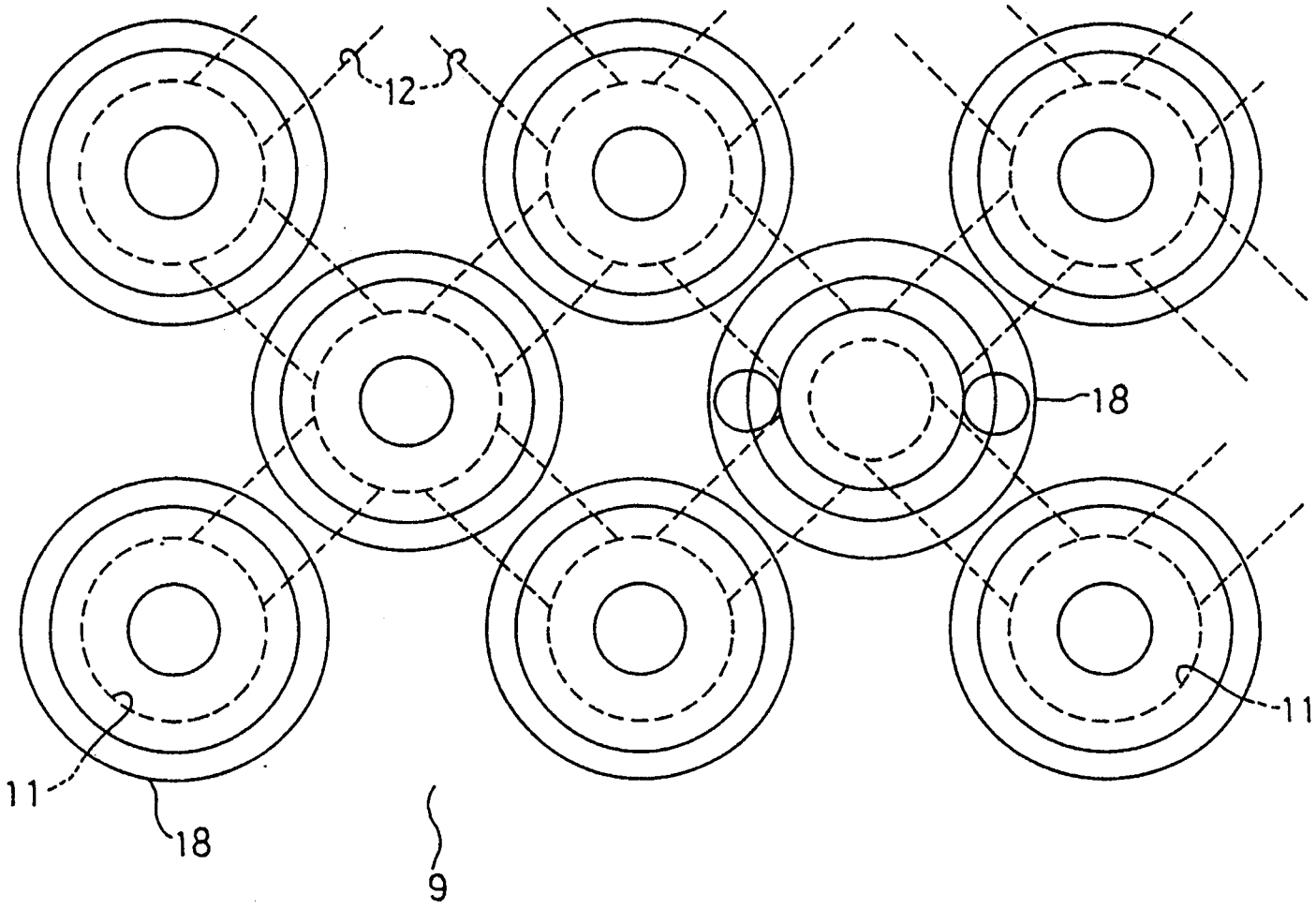
FIG. 3 is a plane view of a principal part of the first embodiment of an apparatus for sucking by negative pressure with the present invention.
Figure 4:
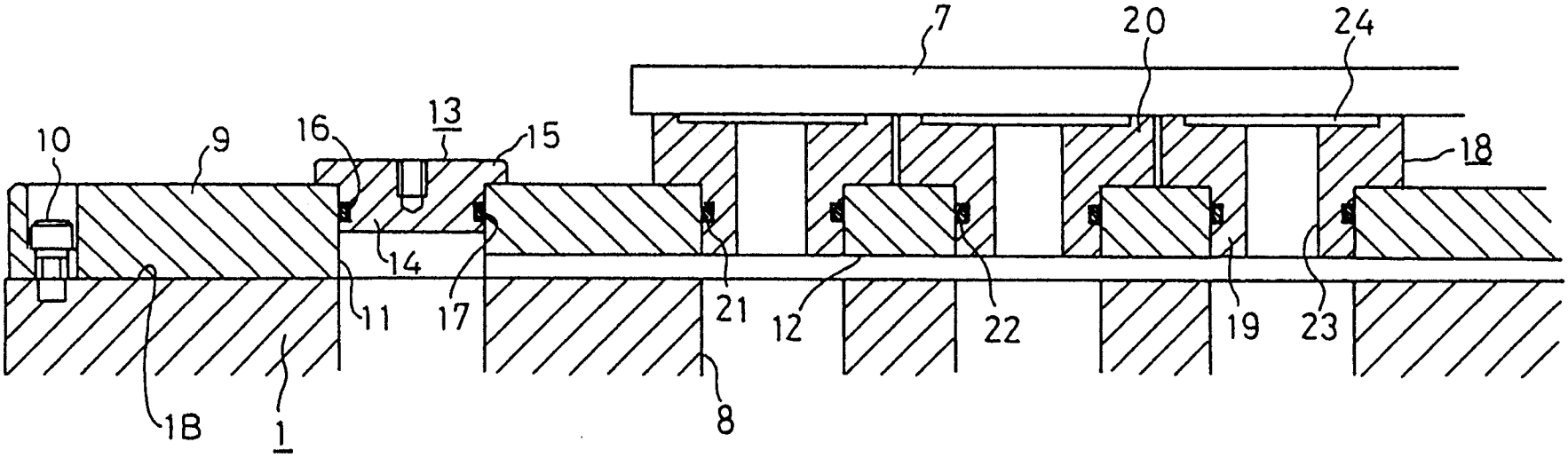
FIG. 4 is a longitudinal sectional view of FIG. 3.

First Embodiment, FIGS. 3–4

In this embodiment, the mounting position of a top wall 1B of a table 1 is provided with plural circular openings 8 in such a condition that the openings 8 line up lengthwise and crosswise as shown in FIG. 3. A sucking plate 9 which has about the same plane area as the top wall 1B is piled up on the top wall 1B and is fixed to the top wall 1B by plural bolts 10. The sucking plate 9 is provided with plural circular openings 11 each of which agrees with a corresponding opening 8. The bottom surface of the sucking plate 9 is provided with plural straight grooves 12 in such a condition that the grooves 12 are grid-shaped on the whole in order that each groove 12 can connect one opening 11 with the next opening 11.

Furthermore, the top surface of the sucking plate 9 is grinded in order to decrease the deviation from flatness.

There provides plural blind caps 13 and plural sucking pads 18, and each of the cap 13 can be removably fitted into the opening 11.

The blind cap 13 is provided with a discoid body 14 and a flat circular head 15. The body 14 has nearly the same diameter as the inside diameter of the opening 11 and can be fitted into the opening 11. The top of the body 14 is provided with the head 15 which has a greater diameter than that of the body 14 so that the head 15 can be mounted on the fringe of the opening 11 which is a part of the top surface of the sucking plate 9. Moreover, the outer peripheral surface of the body 14 is provided with a circular groove 17 in which an O ring 16 is fitted in order to maintain the airtightness between the blind cap 13 and the opening 11.

The sucking pad 18 is provided with a discoid body 19 and a discoid head 20. The body 19 has nearly the same diameter as the inside diameter of the opening 11 and can be fitted into the opening 11. The top of the body 19 is provided with the head 20 which has a greater diameter than that of the body 19, so that the head 20 can be mounted on the fringe of the opening 11 which is a part of the top surface of the sucking plate 9. Moreover, the height of the head 20 of the sucking pad 18 is higher than that of the head 15 of the blind cap 13. Furthermore, the outer peripheral surface of the body 19 is provided with a circular groove 22 in which an O ring 21 is fitted in order to maintain the airtightness between the sucking pad 18 and the opening 11.

The center portion of the sucking pad 18 is provided with a penetration hole 23 which penetrates the body 19 and the head 20 in a vertical direction. The top surface of the head 19 is provided with a circular concave 24 which connects with the penetration hole 23 in order to increase the sphere on which negative pressure works.

Moreover, the sucking pad 18 is made of a material which has a great coefficient of friction as hard rubber in order to hold a workpiece 7 without moving. Furthermore, the top surface of the sucking pad 18 is grinded in order to decrease the deviation from flatness.

The operation of the first embodiment with the above-described construction will be explained in detail below.

In accordance with the size and the shape of a workpiece 7, one or plural sucking pads 18 are fitted into each opening 11 of the sucking plate 9, which opening 11 is covered with the workpiece 7 and a blind cap 13 is fitted into each of the other openings 11 which are not covered with the workpiece 7.

The workpiece 7 is mounted on the sucking pads 18, then a vacuum pump (not shown) or a blower (not shown) is operated, so that the air in a negative pressure recess (not shown) is drawn. As a result, each part of the workpiece 7, which part is facing the concave 24 is sucked downward and the workpiece 7 is held on the sucking pads 18.

Figure 1:
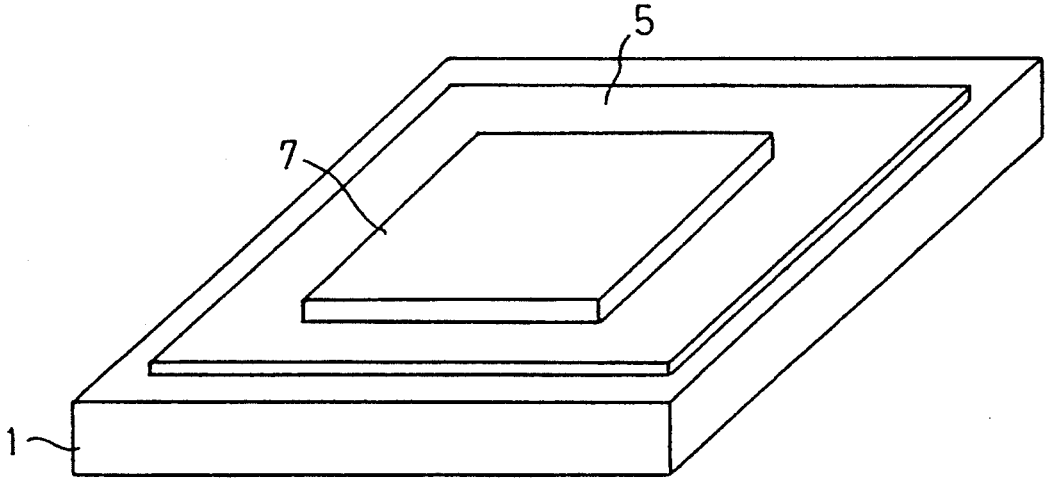
FIG. 1 (PRIOR ART)
FIG. 1 is a squint view of a prior art apparatus.
Figure 2:
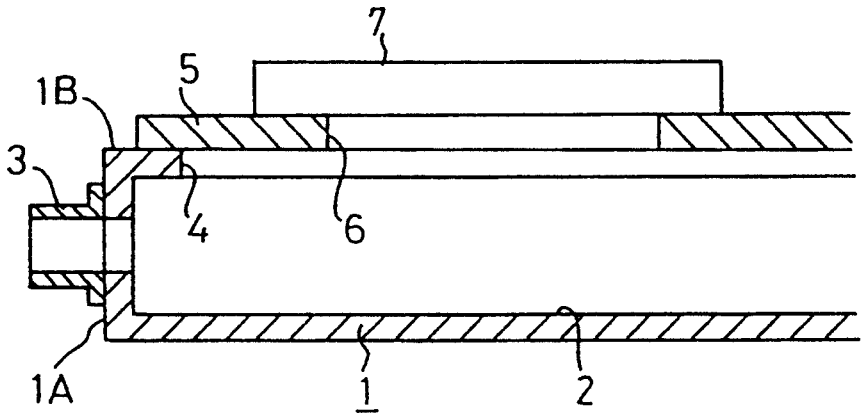
FIG. 2 (PRIOR ART)
FIG. 2 is a longitudinal sectional view of FIG. 1.

According to the first embodiment, if the sucking pads 18 are fitted into each opening 11 which is covered with the workpiece 7 and the blind caps 13 are fitted into each of the other openings 11 which is not covered with the workpiece 7, the workpiece 7 can be certainly held on the sucking pads 18 without using the plate 5 as shown in FIGS. 1 and 2. As a result, the apparatus for sucking by negative pressure described in the first embodiment can increase the productivity decrease the manufacturing cost and increase the quality of the products.

Figure 6:
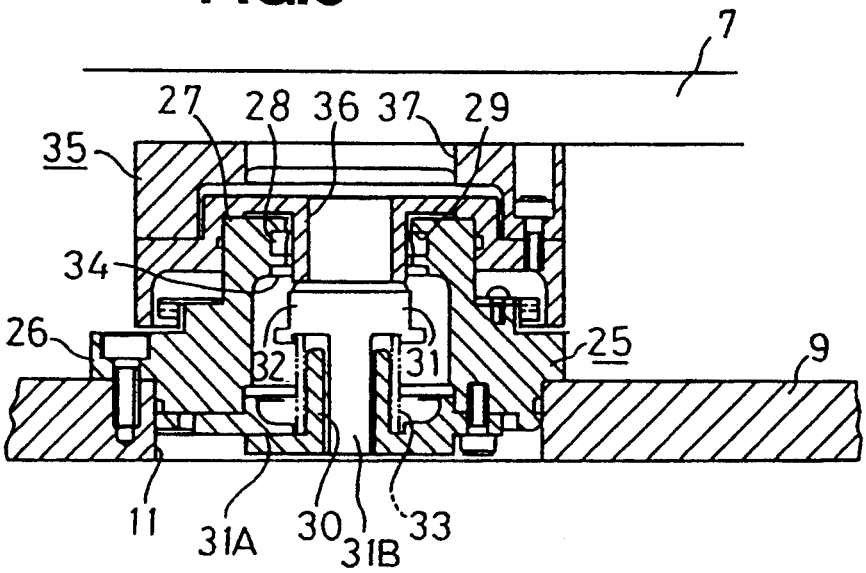
FIG. 6 is a longitudinal sectional view of FIG. 5.
Figure 5:
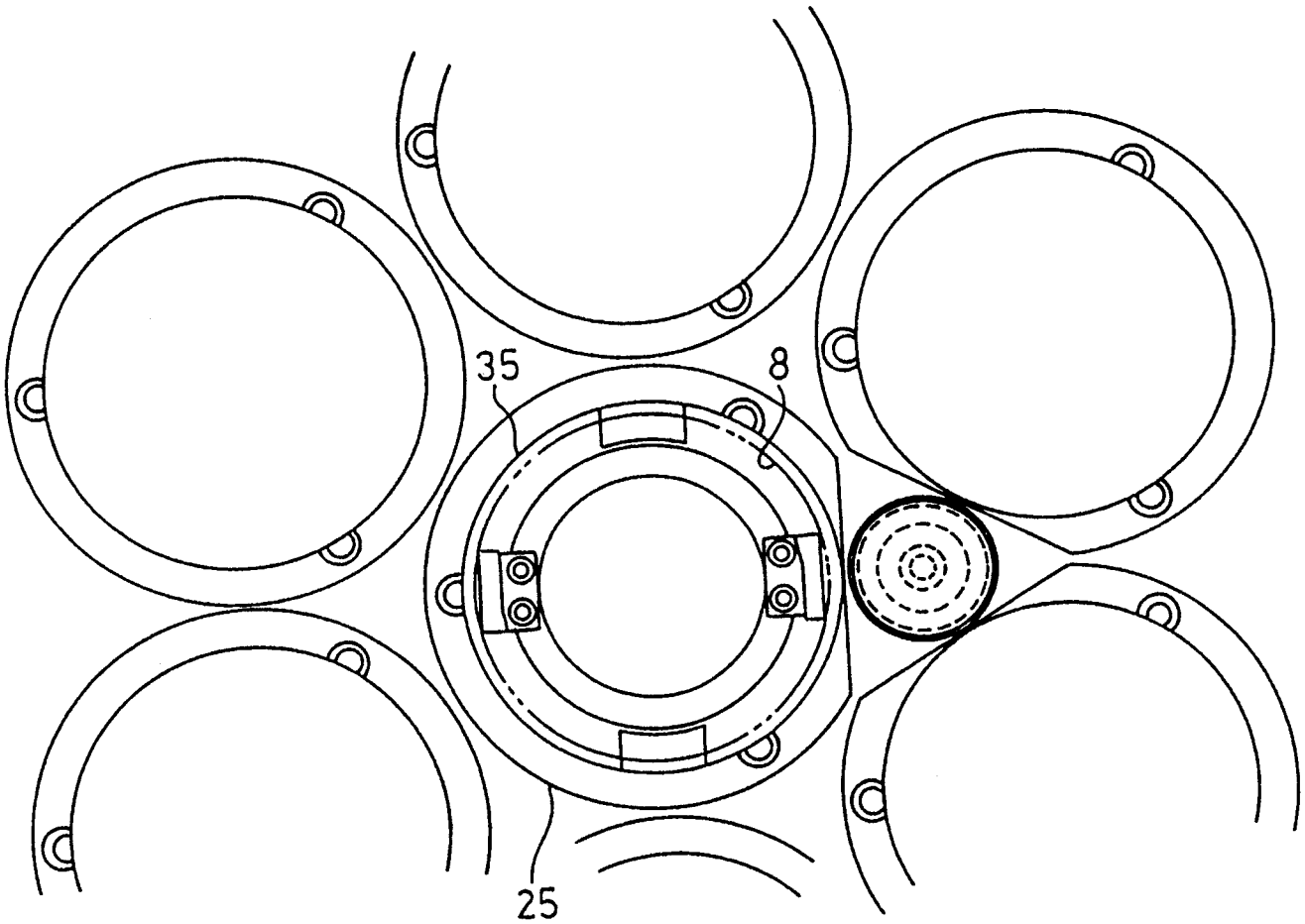
FIG. 5 is a plane view of a principal part of the second embodiment of an apparatus for sucking by negative pressure with the present invention.

Second Embodiment, FIGS. 5–6

In this embodiment, a sucking plate 7 is provided with a plurality of circular openings 11 each of which agrees with a corresponding opening 8 of the top surface 1B of a table 1 in the same manner as the first embodiment.

A valve 25 is fixed in each opening 11. This valve 25 is provided with a circular valve member 26 which is fixed to the top surface of the sucking plate 9 in such a condition that the inner part of the valve member 26 is fitted into the opening 11. The inside of the upper part of the valve member 26 is provided with a circular valve seat 27 and the inside peripheral surface of the valve seat 27 is a contact surface touched with a valve body 31 as this valve body 31 slides the contact surface of the valve seat 27. This contact surface is provided with a circular groove 29 in which an O ring 28 is fitted in order to maintain the airtightness between the valve seat 27 and the valve body 31. The lower end of the valve member 26 is provided with a circular guide sleeve 30 which diameter is smaller than the inner diameter of the valve seat 27 in such a condition that the guide sleeve 30 and the valve seat 27 is concentric.

The inside of the valve member 26 is provided with the valve body 31 which can contact with the valve seat 27, so that the ventilation of the air is obstructed. The valve body 31 is formed with a columnar main part 31A which can be put contact with the valve seat 27, and a valve stem 31B which is extended below the main part 31A and is guided by the guide sleeve. The valve body 31 can move vertically between the upper position and the lower position. The main part 31A is put into contact with the valve seat 27 in order to obstruct the ventilation of the air in the upper position of the valve body 31 and is separated downward from the valve seat 27 in order to allow the air to ventilate in the lower position of the valve body 31.

There provides a coiled spring 33 between the lower end of the valve member 26 and the main part 31A of the valve body 31. The coiled spring 33 is located around the guide sleeve 30 and can force up the valve body 31 by it's elastic force. The main part 31A of the valve body 31 is provided with a stopper 34 which can engaged with the lower end of the valve seat 27, so that the valve body 31 is stopped while the main part 31A of the valve body 31 is put into contact with the valve seat 27. Accordingly, when the valve body 31 is in it's free condition, the main part 31A is put into contact with the valve seat 27, so that the ventilation of the air is obstructed.

The valve member 26 is provided with a opening (not shown) which allow the air being inside of the valve seat 27 entering a negative pressure recess (not shown). Moreover, the main part 31A of the valve body 31 is provided with an air passage (not shown) which can connect the upper end of the main part 31A with the outer peripheral surface of the same.

The valve 25 is provided with a sucking pad 35 which is detachably fitted on the valve 25. The sucking pad 35 can be mounted on the top of the valve member 26. The inside of the sucking pad 35 is provided with a thrust sleeve 36 which makes the valve body 31 descend with the thrust sleeve 36 resisting the elastic force of the coiled spring 33 and separate from the valve seat 27 when the sucking pad 35 is fitted on the valve 25. The sucking pad 35 with the thrust sleeve 36 has suitable weight which can make the coiled spring 33 bend automatically when the sucking pad 35 is fitted on the valve 25. Moreover, the top surface of the sucking pad 35, which surface constructs a workpiece mounting surface is formed into a plane surface and this plane surface is formed with a concave 37 which has a big plane area.

The operation of the second embodiment with the above-described construction will be explained in detail below.

In accordance with the size and the shape of a workpiece 7, one or plural sucking pads 35 are fitted on each valve 25 which is covered with the workpiece 7, so that each thrust sleeve 36 of the sucking pad 35 makes each of the corresponding valve body 31 of the valve 25 descend, and each of the valve body 31 is separated from each of the corresponding valve seat 27. As a result, one or plural air passages which connected the concave 37 of each sucking pad 35 with the negative pressure recess (not shown) of the table 1 through the inside of each thrust sleeve 36 and the opening (not shown) of each valve member 26 respectively. In the meantime, concerning the other valves 25 which are not covered with the sucking pads 35, each main part 31A of the valve body 31 maintains to contact the valve seat 27, so that the air above the valve body 31 is not sucked downward.

The workpiece 7 is mounted on the sucking pads 35, then a vacuum pump (not shown) or a blower (not shown) is operated, so that each part of the workpiece 7, which part is facing the concave 37 is sucked downward and the workpiece 7 is held on the sucking pads 35.

According to the second embodiment, if the sucking pads 35 are fitted on each of the valve 25 which is covered with the workpiece 7, the workpiece 7 can be certainly held on the sucking pads 35 without using the plate 5 as shown in FIGS. 1 and 2. As a result, the apparatus for sucking by negative pressure described in the second embodiment can increase the productivity, decrease the manufacturing cost and increase the quality of the products. Moreover, concerning the apparatus in the second embodiment, it is not necessary to cover the valves 25 with blind caps 13 as shown in FIG. 4, which valves 25 are not covered with the workpiece.

Figure 7:
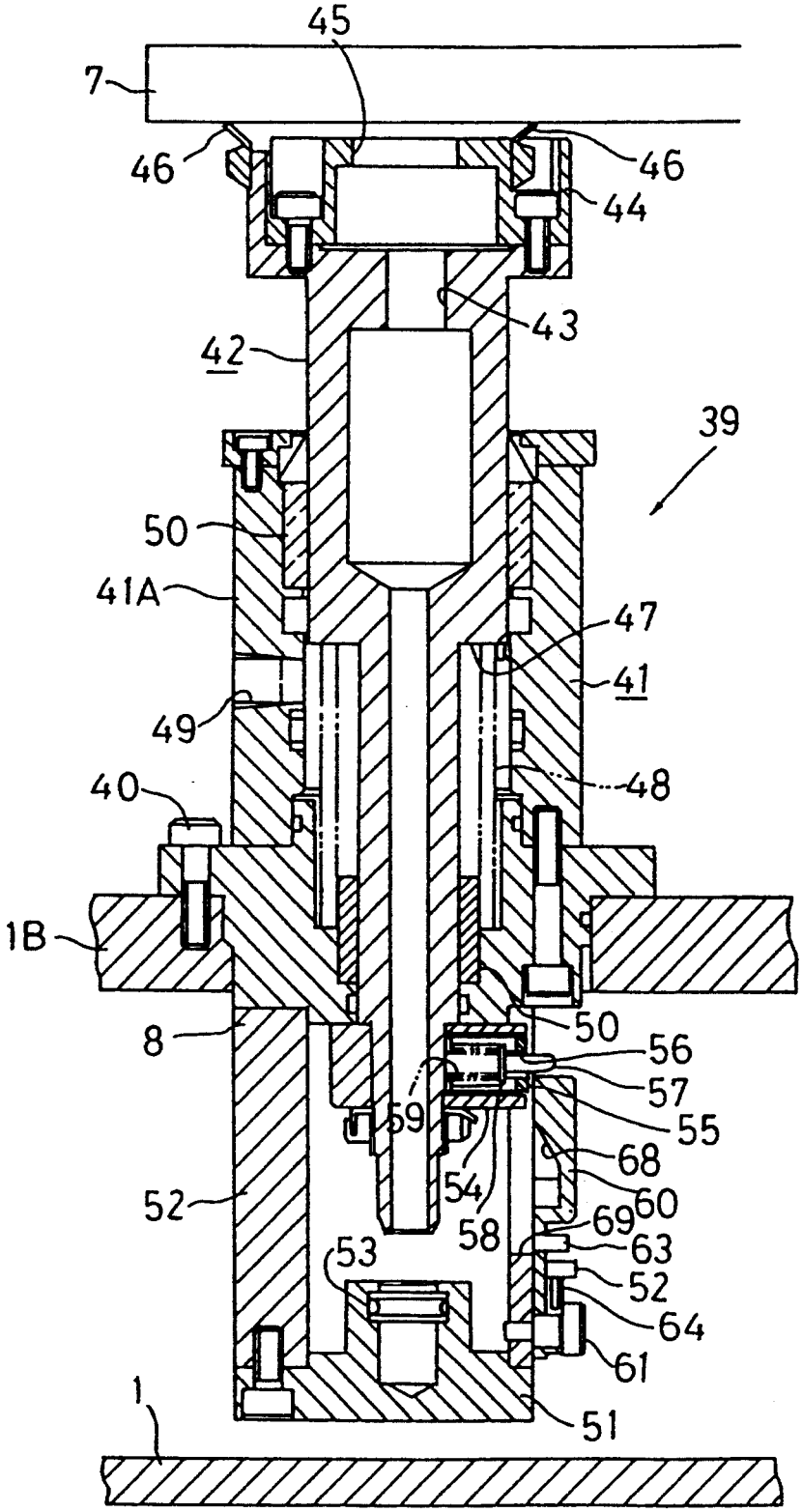
FIG. 7 is a longitudinal sectional view of a principal part of the third embodiment of an apparatus for sucking by negative pressure with the present invention.
Figure 8:
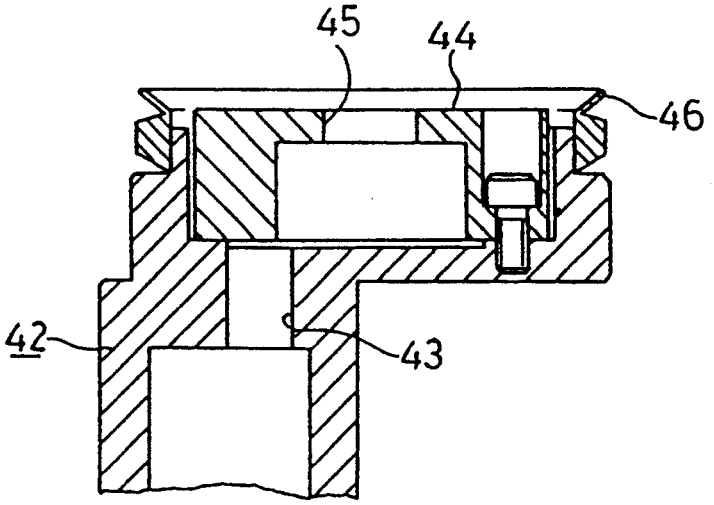
FIG. 8 is a longitudinal sectional view of a different embodiment of a sucking pad.
Figure 9:
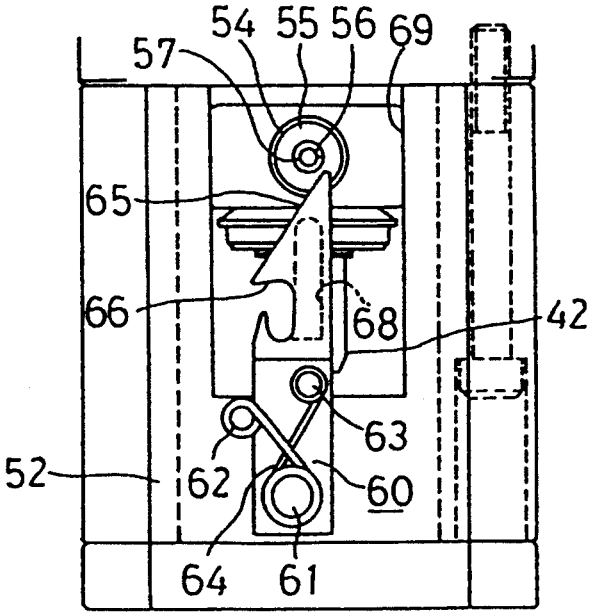
FIG. 9 is a right side view of a principal part of FIG. 7.

Third Embodiment, FIGS. 7–9

FIG. 7 shows the third embodiment of this invention. In this invention, a workpiece mounting position of the top wall 1B of the table 1 is provided with a plurality of circular openings 8 (only one is shown) in the same manner as the first embodiment.

A sucking mechanism 39 by negative pressure is fixed in each opening 8. The mechanism 39 is provided with a cylinder 41 which is fixed to the top wall 1B by plural bolts 40. The main part of the cylinder 41 is extended over the opening 8 and the lower end part of the cylinder 41 is fitted into the opening 8.

The inside of the cylinder 41 is provided with a vertically movable piston 42 the upper part of which is extended over the cylinder 41. The inside of the piston 42 is provide with a vertical air passage 43 which penetrates the piston 42 from the upper end to the lower end. The upper end part of the piston 42 is provided with a sucking pad 44 and the top surface of the sucking pad 44 is shaped into a plane surface, so that the top surface can attract a workpiece 7. The upper end of the sucking pad 44 is provided with a seal lip 46 in order to maintain the airtightness between the sucking pad 44 and the workpiece 7. The upper end of the piston 12 can be also provided with the seal lip 46. Moreover, as shown in FIG. 8, the seal lip 46 can be put in the piston 12 eccentrically as occasion demands.

The outer surface of the piston 42 is provided with a downward annular surface 47 and the diameter of the lower part of the piston 42 from the annular surface 47 is smaller than that of the upper part of the piston 42 from the annular surface 47. There provides a coiled spring 48 between the annular surface 47 and the lower part of the cylinder 41, and the coiled spring 48 can force up the piston 42 by it's elastic force. The outer wall 41A of the cylinder 41 is provided with a connecting hole 49 which can connect the outside of the cylinder 41 with the inside of the same. The connecting hole 49 is located in the lower close position with the annular surface 47 of the piston 42 when the piston 42 is in a rising position. An air supply device (not shown) as a compressor is connected with the outside of the connecting hole 49. The air of the inside of the cylinder 41 supplied by the air supply device acts on the annular surface 47, so that the piston 42 is maintained in it's rising position with the help of the coiled spring 48. Moreover, there provides a seal member 50 between the cylinder 41 and the piston 42.

The lower end of the cylinder 41 is provided with a supporting member 52 which is extended downward. The lower end of the supporting member 52 is provided with a bottomed intercepting cup 51 which can receive the lower end part of the piston 42 when the piston 42 is in the descending position in order to intercept the air sucking from the lower end of the air passage 43 of the piston 42. The inside of the intercepting cup 51 is provided with an O ring 53 in order to maintain the airtightness between the inside and the outside of the intercepting cup 51 when the lower end part of the piston 42 is in the cup 51.

The lower outer surface of the piston 42 is provided with a cylindrical guide sleeve 54 which is extended to the outer direction in the radius direction of the piston 42. The front end of the guide sleeve 54 is provided with a cover plate 55 which has a center bore 56. The inside of the guide sleeve 54 is provided with a pin 57 which is movable in the axial direction of the guide sleeve 54. The outer surface of the pin 57 is provided with a flange 58 which prevents the pin 57 passing through the center bore 56 of the cover plate 55. Moreover, the inside of the guide sleeve 54 is provided with a coiled spring 59 which can force the pin 57 outward from the cover plate 55.

An upward hook 60 which construct a clamp device cramping the piston 42 in it's descending position is pivotally mounted in a vertical surface on a supporting pin 61.

As shown in FIG. 9, the hook 60 is touched with a stopper pin 62 fixed to the supporting member 52 when the hook 60 is in the rising position in order that the hook 60 can not be turned around further more to the counterclockwise direction. Moreover, the hook 60 is provided with a pin 63 which is parallel to the stopper pin 62 and there provides a wire spring 64 which can turn the hook 60 around to the counterclockwise direction between the stopper pin 62 and the pin 63 through the supporting pin 61.

The upper end part of the hook 60 is provided with an oblique edge 65 on which the pin 57 slides, so that the hook 60 is turned around to the clockwise direction, resisting the elastic force of the wire spring 64. Moreover, the hook 60 is provided with a concave 66 which is under the oblique edge 65 and receives the pin 57 in order to clamp the pin 57. The surface of the hook 60, which surface can face the pin 57 is provided with a guide groove 68 which is connected with the concave 66 at the side of the concave 66 and the pin 57 is fitted in. The guide groove 68 is extended to the upper part of the hook 60 and the depth of the guide groove 68 is gradually reduced toward the upper part of the groove 68 as shown in FIG. 7, so that the pin 57 is sunk deeply in the guide sleeve 68 toward the upper part of the groove 68 resisting the elastic force of the coiled spring 59.

The supporting member 52 near the hook 60 is provided with an opening 69 which can ventilate the air.

The operation of the third embodiment with the above-described construction will be explained in detail below.

In accordance with the size and the shape of a workpiece 7, each piston 42 of the mechanism 39 for the sucking by negative pressure, which mechanism 39 covered with the workpiece 7 is maintained in the rising position. Each piston 42 in the rising position is stably maintained in the position by the elastic force of the coiled spring 48 and the force of the compressed air which is supplied through the connecting hole 49 and acts on the annular surface 47 of the piston 42. Moreover, when the piston 42 is in the rising position, the lower end part of the piston 42 is separated from the intercepting cup 51, so that the air in the air passage 43 of the piston 42 is sucked from the lower end of the passage 43. As a result, the air is sucked downward from the opening 45 of the sucking pad 44 on the top of the piston 42.

In the meantime, the other pistons 42 of the mechanism 39 which are not covered with the workpiece 42 are descended by an operator or a robot (not shown) pushing down the sucking pad 44, so that the pin 57 descends as the pin 57 slides on the oblique edge 65 of the hook 60 and make the hook 60 turn around to the clockwise direction, resisting the elastic force of the wire spring 64.

When the piston 42 descended to some degree, the pin 57 passes through the oblique edge 65 and faces the concave 66. Thereupon, the hook 60 turns round to the counterclockwise direction by the elastic force of the wire spring 64 and catches the pin 57 in the concave 66, so that the ascent of the piston 42 is clamped. Moreover, in this condition the lower end part of the piston 42 which is in the descending position is received in the bottomed intercepting cup 51, so that the air is not sucked from the air passage 43 of the lower end of the piston 42. As a result, the air is not sucked downward from the opening 45 of the sucking pad 44 on the top of the piston 42 which is in the descending position. When the piston 42 is in the descending position, the annular surface 47 of the piston 42 is located under the connecting hole 49 of the cylinder 41, so that the compressed air does not act on the annular surface 47.

The workpiece 7 is mounted on each of the sucking pads 35 on the pistons 42 each of which is in the rising position, then a vacuum pump (not shown) or a blower (not shown) is operated, so that each part of the workpiece 7, which part is facing the opening 45 of the sucking pad 44 is sucked downward and the workpiece 7 is held on the sucking pads 44.

Furthermore, in order to place to the other sucking pads 44 which were not used to hold the workpiece 7, at the service of fixing the same because of the change of the workpiece's shape, it had better to descend the pistons 42 again. Each of the pin 57 is descended together with the piston 42 and the pin 57 is descended a little in the concave 66, so that the pin 57 faces the guide groove 68 of the hook 60. In this condition the hook 60 is turned around to the counterclockwise direction in FIG. 9 by the elastic force of the wire spring 64 and the pin 57 is introduced into the guide groove 68. Thereupon, the pin 57 is released from the concave 66 of the hook 60. As a result, the piston 42 is risen by the elastic force of the coiled spring 48 and the sucking pad 44 of the piston 42 is placed at the service of holding the workpiece 7.

According to the third embodiment, if the pistons 42 each of which is not covered with the workpiece 7 are merely descended, the workpiece 7 can be certainly held on the sucking pads 44 without using the plate 5 as shown in FIGS. 1 and 2. As a result, the apparatus for sucking by negative pressure described in the third embodiment can increase the productivity, decrease the manufacturing cost and increase the quality of the products.

Moreover, concerning the apparatus in the third embodiment, programming to push all the sucking pads 44 each of which does not face the workpiece 7 by a numerical control system, the apparatus can be used to suck many kind of workpieces 7 without assistance.

What is claimed is:

1. An apparatus for sucking an article on a table the inside of which is provided with a negative pressure recess by negative pressure, characterized in that the upper part of the table is provided with plural sucking mechanisms each of which comprising:

a vertically movable piston the top of which is provided with a sucking pad and the inside of which is provided with a air passage from the top to the bottom, the piston being forced up by an elastic member;

a hook device clamping the piston in its descending position and releasing the clamped piston with the descent of the piston; and an intercepting device intercepting the air passage in the piston in its descending position from the negative pressure recess.

2. An apparatus for holding an article in a fixed position comprising a plurality of holders, each holder comprising:

a. a hollow piston slidably mounted in the holder allowing the piston to be located in ascended and descended positions, the piston having a suction cup at one end and an opening at the other end; and b. a clamp pivotally mounted to the holder, the clamp engaging the piston when the piston is in the descended position and maintaining the piston in the descended position.

3. The apparatus of claim 2 wherein each holder includes a spring for biasing the piston toward the ascended position.

4. The apparatus of claim 2 wherein each of the holders includes an intercepting device for sealing the other end of the piston when the piston is in the descended position.

5. The apparatus of claim 2 wherein the piston includes a pin and wherein the clamp includes a hook having a guide groove for engaging with the pin to hold the piston in the descended position.

6. The apparatus of claim 5 wherein the clamp includes a spring for biasing the clamp for maintaining the piston in the descended position.

* * * * *